US006353579B1

(12) United States Patent
Ciervo

(10) Patent No.: US 6,353,579 B1
(45) Date of Patent: Mar. 5, 2002

(54) DISPLAY ILLUMINATION FOR AN ELECTRONIC DEVICE

(75) Inventor: Richard D. Ciervo, New Britain, CT (US)

(73) Assignee: Timex Group B.V. (NL)

( * ) Notice: Subject to any disclaimer, the term of this patent is extended or adjusted under 35 U.S.C. 154(b) by 0 days.

(21) Appl. No.: 09/633,372

(22) Filed: Aug. 7, 2000

(51) Int. Cl.[7] ..... G04B 19/30
(52) U.S. Cl. ..... 368/67; 368/227
(58) Field of Search ..... 368/67, 82, 84, 368/227

(56) References Cited

U.S. PATENT DOCUMENTS

| | | | |
|---|---|---|---|
| 4,033,108 | A | 7/1977 | Bennett et al. |
| 4,084,401 | A | 4/1978 | Belradi et al. |
| 4,094,139 | A | 6/1978 | Nomura et al. |
| 4,283,784 | A | 8/1981 | Horna |
| 4,527,096 | A | 7/1985 | Kindlmann |
| 4,780,864 | A | 10/1988 | Houlihan |
| 4,783,773 | A | 11/1988 | Houlihan et al. |
| 4,912,688 | A | 3/1990 | Syfert |
| 5,555,226 | A | 9/1996 | Lizzi |

*Primary Examiner*—Vit Miska
(74) *Attorney, Agent, or Firm*—Carmody & Torrance LLP

(57) ABSTRACT

A method of illuminating a display in an electronic device comprising a display, a lamp for illuminating said display, a plurality of actuated switches one of which is a lamp switch that when activated, causes the activation of the lamp to illuminate the display, and an integrated circuit coupled to the plurality of actuated switches, the integrated circuit being able to sense the activation of each of the plurality of actuated switches, wherein the method comprises the steps of sensing the activation of the lamp switch, activating the lamp to illuminate the display for a first predetermined period of time, sensing the activation of another one of the plurality of actuated switches, determining whether the another one of the plurality of actuated switches was activated while the display was illuminated; and if so maintaining the illumination of the display.

20 Claims, 2 Drawing Sheets

DISPLAY ILLUMINATION FOR AN ELECTRONIC DEVICE

BACKGROUND OF THE INVENTION

The present invention relates generally to improvements in operating an illuminated display for a multimode or multifunction electronic device, such as a timepiece, and a watch in particular, and more particularly, the invention relates to an improved logic sequence for such an electronic device for illuminating the display of the electronic device.

Means for illuminating wristwatch dials or liquid crystals displays which could otherwise not be easily seen in the dark are well known. Generally, the lamp illuminating the display or dial is lit by pressing a pushbutton to close contacts inside the device (i.e. the watchcase) so as to change the electrical potential on an integrated circuit input pin, signifying a switch closure.

In actual practice, the manual actuator may either be a dedicated switch which only serves to light the illuminating lamp, or the switch may incidentally cause the lamp to light while some other function is being performed with the switch. Electronic watches are also known, in which various special lighting functions or timing functions are performed when the manual actuators are operated in a preselected manner, such as those described in U.S. Pat. Nos. 4,084,401, 4,094,139 and 4,033,108.

Multimode, multifunction electronic devices, such as watches, are known to include a display, a lamp for illuminating the display, a number of manually actuated switches and an integrated circuit programmable in preselected sequences, examples of which are described in U.S. Pat. Nos. 4,783,773, 4,780,864 and 4,283,784, all of which are assigned to the present assignee.

Yet another example of a display illumination logic sequence to facilitate the use of a timepiece is described in U.S. Pat. No. 4,912,688 to Syfert. This '688 patent describes a logic sequence to light the lamp in response to actuation of a first switch, to change modes in response to actuation of a second switch and to change information displayed in each mode in response to actuation of a third switch, wherein in response to actuating the first switch for more than two seconds, the first logic sequence is altered into a second logic sequence wherein actuation of either of the second or third switches will automatically light the lamp momentarily in addition to duplicating the first logic sequence. The display methodology returns the timepiece to the first logic sequence after a selected period of time.

The inventor of the present invention has found however, that an alternative and yet still novel and nonobvious display illumination construction and methodology can still further improve upon the state of the art in this regard and can provide for yet unrealized advantages, as will be set forth below. Accordingly, a device and methodology that provides such an improved display illumination construction and methodology for an electronic device is desired, and is embodied in the present invention disclosed herein.

SUMMARY OF THE INVENTION

Generally speaking, in accordance with the present invention, a multimode electronic device is provided. In the preferred embodiment, the electronic device preferably includes a display, a lamp for illuminating the display, a plurality of actuated switches, and an integrated circuit coupled to the plurality of actuated switches and able to sense the activation of each of the plurality of actuated switches. The device will include software, hardware, or a combination thereof, for (i) determining that one of the plurality of actuated switches, such as, for example but not in a limiting sense, a dedicated lamp switch was activated, (ii) for activating the lamp to illuminate the display for a first predetermined period of time in response to the determining that the first switch (i.e. the dedicated switch) was activated, for (iii) also determining if another switch, other than the dedicated switch, has been activated, and if so, for determining whether the other switch was activated while the display was being illuminated. The device will continually maintain the illumination of the display if any of the other switches are activated during the period that the display is being illuminated. In a particular feature of the present invention, the integrated circuit will restart the time period for which the display remains illuminated and maintains the illumination of the display for such a predetermined period of time each time any of the manual switches are activated. In the preferred embodiment, the restarting and each subsequent period of time is the same as the initial predetermined period of time. However, the present invention recognizes the ability to restart the illumination period for different time periods, depending, for example, on the switches depressed, rotation of the ring (as disclosed below), or combination or sequence thereof.

For example, if the lamp is activated by the depression of the lamp switch, the display will illuminate, if no other switches are activated, for the predetermined period, for example, three (3) seconds, after which the lamp will deactivate and the display will no longer be illuminated. If however, during those three (3) seconds, one of the other actuatable switches are depressed, and this is sensed by the integrated circuit, the display will remain illuminated and the activation period during which the lamp will illuminate the display will be restarted (i.e. from the time that the other switch is activated the display will remain illuminated for another period of time (in the most simplest of embodiments, three (3) more seconds)) before it will shut off should no other switches be activated. That is, the lamp will deactivate if no other actuated switches are activated during the predetermined period of time. Each successive activation of a switch will restart the count process.

In another embodiment, the multimode electronic device comprises a display, a lamp for illuminating the display, a plurality of actuated switches wherein one of the actuated switches is a lamp switch that when activated, causes the illumination of the display, and an integrated circuit coupled to the plurality of actuated switches and able to sense the activation of each of the plurality of actuated switches, wherein the integrated circuit causes the activation of the lamp to illuminate the display when the lamp switch is activated, starts a count process that maintains the illumination of the display for a predetermined period of time, senses the activation of another one of the plurality of actuated switches and determines whether the another one of the plurality of actuated switches was activated while the display was being illuminated, and if so, restarts the count process so that the illumination of the display is maintained for another predetermined period of time (such as three (3) seconds) beginning when the another one of the plurality of actuated switches was sensed. In this embodiment, the integrated circuit causes the deactivation of the lamp when the activation of another one of the plurality of actuated switches is not sensed during the count process.

Lastly, in accordance with the present invention, a method of illuminating a display in an electronic device is provided. In this embodiment of the invention, the electronic device preferably comprises a display, a lamp for illuminating the display, a plurality of actuated switches one of which is a lamp switch that when activated, causes the activation of the lamp to illuminate the display, and an integrated circuit coupled to the plurality of actuated switches, the integrated circuit being able to sense the activation of each of the plurality of actuated switches, and the method comprises the steps of sensing the activation of the lamp switch, activating the lamp to illuminate the display for a first predetermined period of time, sensing the activation of another one of the plurality of actuated switches, determining whether the another one of the plurality of actuated switches was activated while the display was illuminated, and if so, maintaining the illumination of the display. In further aspects of the invention, the method may include the steps of starting a count process for a predetermined period of time during which the illumination of the display is maintained, determining whether the another one of the plurality of actuated switches was activated during the count process, and if so restarting the count process while maintaining the illumination of the display so that the illumination of the display is maintained for a second predetermined period of time (which may, however be the same as the first predetermined period of time) beginning when the another one of the plurality of actuated switches was activated. In yet another specific feature of the invention, the method includes the steps of starting a count process for a predetermined period of time during which the illumination of the display is maintained, determining whether the count process has terminated, sensing whether the other one of the plurality of actuated switches was activated during the count process, and if so, restarting the count process while maintaining the illumination of the display so that the illumination of the display is maintained for at least essentially a predetermined period of time beginning when the another one of the plurality of actuated switches was activated. The method also includes the step of deactivating the lamp when the other one of the plurality of actuated switches is not activated during the count process. In one embodiment, the count process may include the step of loading a counter with a predetermined value representative of the predetermined period of time, whereby the predetermined period of time is a period of time it takes for the counter to count to a preselected value, such as zero in a countdown counter.

In the preferred embodiment, the electronic device is a timepiece, and a watch in particular. However, as will be well appreciated, the present invention is equally applicable, and as claimed herein shall encompass, devices other than timepieces, such as, but not limited to, clocks, pagers, stopwatches, or other handheld devices for the home or office. Therefore, reference to an electronic device, timepiece or watch should equally be understood to refer to at least any of the aforementioned other devices. That is, the present invention construction and methodology is applicable in any electronic device in which an illumination methodology as disclosed herein is desired.

Accordingly, it is an object of the present invention to provide an electronic device that includes enhanced display illumination capabilities.

Another object of the present invention is to provide an improved display illumination methodology that can be easily incorporated into a multitude of different types of electronic devices, such as timepieces that includes watches, pagers and the like.

Yet another object of the present invention is to provide an improved method of controlling the illumination of the display in an electronic device.

Still another object of the invention is to provide an improved construction and methodology for operating an electronic device to provide automatic illumination of the display while also conserving power.

Another object of the present invention is to provide a display illumination construction and methodology that is easier to use.

Still other objects and advantages of the invention will in part be obvious and will in part be apparent from the specification.

The invention accordingly comprises the features of construction, combination of elements, arrangement of parts and sequence of steps as will be exemplified in the construction, methodologies and flowcharts hereinafter set forth, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
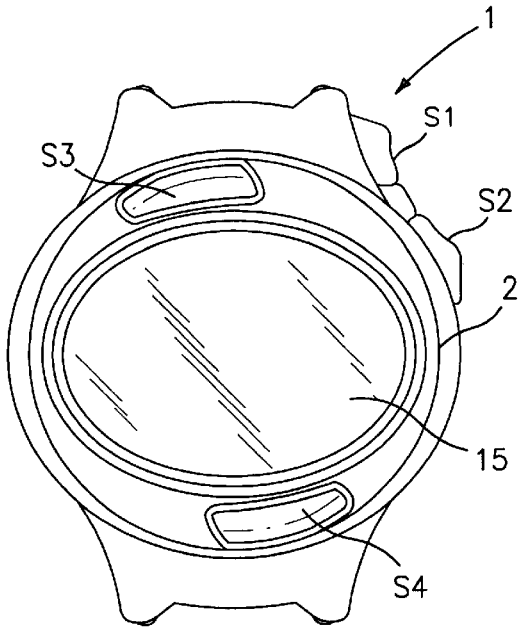
FIG. 1 is a plan view of an electronic device, exemplified by a watch, in simplified form to show certain features relevant to the present invention.

Reference is briefly made to FIG. 1, wherein an electronic device generally indicated at 1, and preferably a multimode electronic device such as a watch, is shown. Hereinafter, reference to the electronic device depicted in FIG. 1 should be well understood to include a timepiece, such as a watch, although such depiction and references are made by way of illustration and not limitation, for the reasons stated above, as one will readily appreciate that the present invention is applicable to many devices such as pager, stopwatches, timers and other hand held devices, etc.

Device 1 includes a case 2 adapted to be held on the wrist by a strap (not shown) as would be understood in the art and shown in further detail in the aforementioned U.S. Pat. No. 4,912,688, the disclosure of which is incorporated by reference as if fully set forth herein. Case 2 preferably includes a plurality of manually actuated switches, such as pushbutton actuators, such as side actuators S1 and S2 and top actuators S3 and S4, arranged to close spring contacts (not shown) inside case 2. Actuators S1, S2, S3 and S4 are provided to operate device 1 within a plurality of modes, as would be readily understood in the art and disclosed for example in U.S. Pat. No. 5,555,226 or pending U.S. application Ser. No. 09/157,343, both of which are assigned to the present assignee and the disclosures of which are both incorporated by reference as if fully set forth herein. In the preferred embodiment, switch S1 may be a dedicated lamp switch for activating the lamp when the lamp is not currently being activated. Switch S2 may be a pushbutton used to set information, such as the time or date within a particular mode, switch S3 may be a START/STOP button for use when device 1 is operating in a TIMER/CHRONO mode, and switch S4 may be used to sequence through the various modes of device 1, such as, but not limited to TIMER, PULSE, CHRONO, ALARM, DATE and TIME. A display 15, which is commonly a liquid crystal display (or LCD), displays digits, letters or other symbols when activated by an integrated circuit, such as a microprocessor, located inside the case.

Preferably, display 15 is illuminated by the activation of a lamp, such as by the construction and methodology set forth in U.S. Pat. No. 4,527,096, also assigned to the present assignee and the disclosure of which is also incorporated by reference as if fully set forth herein. However, it should also be understood that the backlighting arrangement disclosed in copending U.S. Pat. No. 09/328,513, assigned to the present assignee and the disclosure of which is also incorporated by reference as if fully set forth herein, is also fully utilizable in the present invention. Accordingly, the term "display" should also be understood to include a dial such as the dial disclosed in copending application Ser. No. 09/328,513. That is, the term "display" and "dial" should be thought of as interchangeable, where appropriate, such as in the claims, for purposes of the scope of protection afforded thereby.

Figure 2:
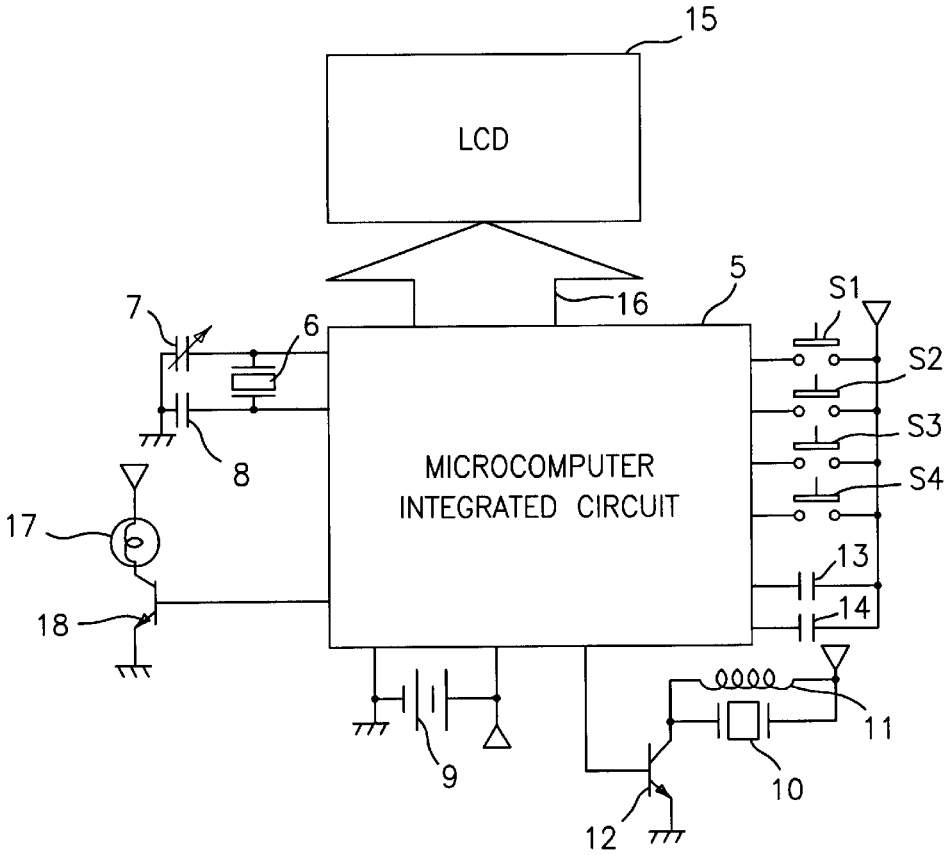
FIG. 2 is a block diagram of a circuit for the electronic device of FIG. 1, together with external components such as lamp, switches and display.

Reference is now made to FIG. 2, wherein a simplified schematic block diagram of some of the more relevant components that are incorporated into or are utilized to carry out the present invention are illustrated. Such general device technology, typically found in the watch technology, should be well known to those skilled in the art. A programmable microcomputer 5, in the form of a mask-programmable integrated circuit is bonded to a printed circuit board (not shown) and includes suitable pin connections and leads connected to various external components shown in the diagram which are also mounted on the printed circuit board. A quartz crystal 6, connected in parallel with capacitor 7 and 8, is also connected to the oscillator pins of the integrated circuit and provides a high-frequency time base. A battery power source 9 is provided in case 2 and may be in the form of a button type energy cell. An alarm, for example and not limitation, comprising a piezoelectric crystal 10, inductance coil 11 and drive transistor 12, may also be provided. Two fixed external capacitors 13, 14 combined with other circuit elements combined inside the integrated circuit 5 serve to boost the output voltage to drive LCD 15 through a display bus 16, which represents the several parallel leads connected to the various actuatable segments of the LCD display 15 (also shown in FIG. 1). Also shown in FIG. 2 are the simplified connections between integrated circuit 5 and actuators S1–S4.

As shown in FIG. 2 display 15 may be arranged in close proximity with, and so as to be illuminated by, a lamp 17 when the lamp is lit by a switching signal from integrated circuit 5 applied to the base of switching transistor 18. Lamp 16 is represented as an incandescent lamp which may either be a backlight behind display 15 or arranged to illuminate it from the top or from the side (again, the lamp and dial combination disclosed in the aforementioned application Ser. No. 09/328,513 is equally applicable here as would be understood by one skilled in the art). It is also within the scope of the invention to use other types of illuminating lamps such as electroluminescent lamps to provide direct lighting or backlighting of the display 15. One preferred lamp that is utilizable with the present invention is that which is disclosed in the aforementioned U.S. Pat. No. 4,527,096.

Figure 3:
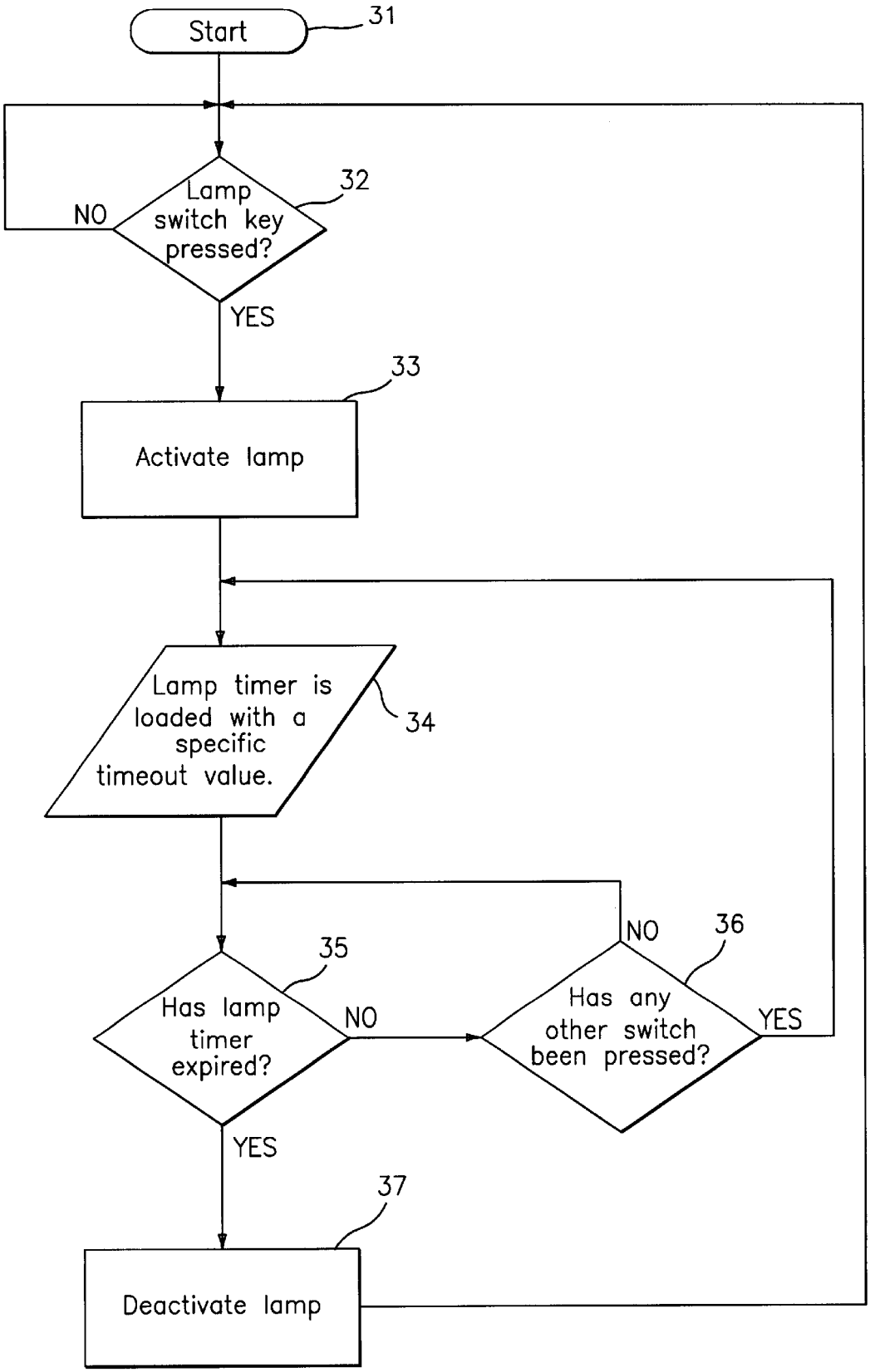
FIG. 3 is a flowchart illustrating a sequence of operations in response to manually actuated switches in accordance with the preferred embodiment of the present invention.

Reference will be made to FIG. 3 to illustrate the methodology of the present invention. As stated above, the present invention discloses and claims a methodology to illuminate, and continue to illuminate a display or dial, such as display 15, continuously or for at least a duration of time during (or more accurately, between) the activation of certain of the aforementioned actuators or manually actuatable switches S1–S4.

Generally speaking however, the method of illuminating the display in the electronic device of FIG. 1 includes the initial step of activating a first switch such as switch S1. In the preferred embodiment, switch S1 may be a dedicated lamp switch, whose only or primary function is to operate the lamp. This activation will activate the lamp and illuminate the display. Without any further actions on the part of the user, the display will be illuminated for a predetermined period of time, for example, three (3) seconds.

In accordance with the invention, the integrated circuit is also sensing the activation of the remaining switches S2–S4, and if any of the other switches, for example, switch S2, is determined to have been activated while the display was still being illuminated (i.e. within the first three second predetermined period of time), the illumination of the display is maintained. More specifically, the illumination methodology in accordance with the invention (and upon the initial activation of switch S1 or after the combination of activations of switch S1 and any of switches S2–S4) will always start a count process for the predetermined period of time (i.e. three seconds) during which the illumination of the display is maintained. If any of the switches S2–S4 are activated during the count process, the count process is restarted, so as to maintain the illumination of the display. It should be also understood that depression of S1 (i.e. the lamp switch) will also maintain the illumination of the display by virtue of maintaining the activation of the lamp in a manner similar to the activation of switches S2–S4. It is recognized that time, on the order of milliseconds, may prevent the count process from being exactly the same, although all minor discrepancies are within the scope of the claims. After the count process is started for the predetermined period of time during which the illumination of the display is maintained, the methodology determines if the count process has terminated, and if so, senses whether one of the other switches S2–S4 was activated during the count process; and if so restarts the count process while maintaining the illumination of the display so that the illumination of the display is always maintained for the predetermined period of time beginning when one of the other switches (S2–S4) was activated. The lamp is deactivated when no other switches S2–S4 are activated during the count process.

It should thus be understood that after the initial activation of switch S1, the lamp may remain activated upon subsequent and repeated activations of switches S1, S2, S3 or S4, or a combination of each, as long as the count process does not "time out." The count process may also include the step of loading a counter with a predetermined value representative of the predetermined period of time, whereby the predetermined period of time is the period of time it takes for the counter to count to a preselected value, such as zero. Achieving this would be well understood by one skilled in the art with the present disclosure before him or her. For example, the counter may be a countdown counter that "counts" down to zero. All of the methodologies set forth herein can be performed by the disclosure herein in combination with FIG. 2, such as the integrated circuit and the software programmed therein. Other details not necessary for the disclosure herein, such as the operation of the lamp, may be in one or more of the disclosures incorporated by reference. Accordingly, all the elements to construct the claimed invention and perform the claimed method are provided for herein and need no experimentation by one skilled in the art. As stated above, the electronic device preferably includes timekeeping circuitry for keeping and displaying time, and is thus preferably a watch.

Turning now specifically to FIG. 3, the illumination subroutine in accordance with the invention begins at Block 31 after the depression of the manually actuated switch that is associated with the initial illumination of the lamp, such as by example, switch S1 as set forth in Block 32. Such an actuation will cause the lamp to be activated (i.e. illumination of the display) as set forth in Block 33. A lamp timer/counter is then loaded with a specific timeout value (Block 34) as would be well understood by one skilled in the art. A counter subroutine or a separate countdown timer as would be understood in the art may carry out such a countdown. Control then passes to Block 35 wherein a determination is made as to whether the countdown timer has expired. If the countdown timer has not expired, and any of the other switches S2, S3 or S4 are actuated as in Block 36 (of course the present invention would work if the subsequent activation was by switch S1, but the novelty of the invention lies in the subsequent activation switches other than the lamp switch, i.e. switches S2, S3 or S4), control again passes to Block 34 where the lamp timer/counter is again loaded with a specific timeout value, such as the aforementioned specific timeout value of three seconds. If, however, the countdown timer has expired in Block 35, control passes to Blocks 37 and 38 respectively, wherein the lamp is deactivated and the subroutine and methodology to maintain the illumination of the lamp ends.

It will thus be seen that the objects set forth above, among those made apparent from the preceding description, are efficiently attained and, since certain changes may be made in the above constructions and methodologies without departing from the spirit and scope of the invention, it is intended that all matter contained in the above description or shown in the accompanying drawings shall be interpreted as illustrative and not in a limiting sense.

For example, the sequence of steps in the aforementioned FIG. 3 may be slightly modified, such as having the decision step of Block 36 appear before the decision step of Block 35 within the loop sequence. That is, checking for another switch closure need not be done when the current timeout expires. In this embodiment, the lamp timeout (i.e. counter) is reloaded with the predetermined value (i.e. three seconds) the moment the next switch closure is sensed. Another contemplated modification is to have any subsequent activation of switches, i.e. switches S2, S3 or S4 begin a separate subroutine wherein the count process disclosed above is for a second or different predetermined time period from that set forth above. That is, assume for example, the depression of S3 was the button for the TIMER mode. Knowing that a setting activity could be necessary, the count process could be set in the subsequent time period to be five (5) seconds. It should be also understood that the methodology of FIG. 3 only sets forth the present invention, as one would well appreciate that the depression of other switches, such as switches S2, S3 or S4 will cause the control of the subroutine pass to other decision or action blocks where information is changed, for example, within other modes of operation. Accordingly, while the complexity of FIG. 3 may be enlarged, the operation of the present invention remains constant.

The present invention also contemplates a more sophisticated lamp switch operation, such as that disclosed in U.S. patent application Ser. No. 09/359,223 (A0421), the disclosure of which is incorporated by reference as if fully set forth herein. That is, instead of the lamp switch S1 being a separate dedicated manual actuator/pushbutton, the lamp switch S1 may be a function of the switching mechanism disclosed in the aforementioned '223 application, wherein depression axial setting stem of the switching mechanism inwardly as described therein would illuminate the lamp. Likewise, depression of the other switches S2, S3 and S4 would be analogous to the rotation of the rotatable ring. That is, for purposes of the scope of the present invention, the rotation of ring clockwise or counterclockwise would be equivalent to the activation of one or more of the switches other than the lamp switch S1. Specifically, the rotation of the ring would send signals to the integrated circuit and be acted upon as in a similar manner as if one of the switches S2, S3 or S4 was depressed. In this way, rotation of the ring, during mode or information setting, would likewise maintain the illumination of the lamp if it was activated in accordance with the methodology set forth above.

It is also to be understood that the following claims are intended to cover all of the generic and specific features of the invention described herein and all statements of the scope of the invention which as a matter of language might fall therebetween.

What I claim is:

1. A multimode electronic device comprising a display, a lamp for illuminating the display, a plurality of actuated switches, and an integrated circuit coupled to the plurality of actuated switches, the integrated circuit being able to sense the activation of each of the plurality of actuated switches, the electronic device comprising:

a determiner for determining the activation of a first one of the plurality of actuated switches;

an illuminator for activating the lamp to illuminate the display for a first predetermined period of time in response to the determining that the first one of the plurality of actuated switches was activated;

the determiner for also determining the activation of another one of the plurality of actuated switches and for determining whether the activation of the another one of the plurality of actuated switches was activated while the display was being illuminated;

wherein the illuminator maintains the illumination of the display for a second predetermined period of time beginning at least essentially when the determiner determined that the another one of the plurality of actuated switches was activated.

2. The electronic device as claimed in claim 1, wherein the first predetermined period of time equals the second predetermined period of time.

3. The electronic device as claimed in claim 1, wherein the integrated circuit restarts the time period for which the display remains illuminated and maintains the illumination of the display for the second predetermined period of time.

4. The electronic device as claimed in claim 1, including means for deactivating the lamp if the another one of the plurality of actuated switches is not activated during the first predetermined period of time.

5. The electronic device as claimed in claim 1, wherein the device includes timekeeping circuitry for keeping and displaying time.

6. The electronic device as claimed in claim 5, wherein the device is a watch.

7. The electronic device as claimed in claim 1, wherein the determiner is comprised of at least electrical contacts between each of the switches and the integrated circuit and the illuminator is comprised of circuitry for illuminating the lamp.

8. A multimode electronic device comprising:

a display;

a lamp for illuminating the display;

a plurality of actuated switches wherein one of the actuated switches is a lamp switch that when activated, causes the illumination of the display;

and an integrated circuit coupled to the plurality of actuated switches and able to sense the activation of each of the plurality of actuated switches, wherein the integrated circuit causes the activation of the lamp to illuminate the display when the lamp switch is activated, starts a count process that maintains the illumination of the display for a predetermined period of time, senses the activation of another one of the plurality of actuated switches and determines whether the another one of the plurality of actuated switches was activated while the display was being illuminated, and if so, restarts the count process for a second predetermined period of time so that the illumination of the display is maintained for at least the second predetermined period of time beginning when the another one of the plurality of actuated switches was sensed.

9. The electronic device as claimed in claim 8, wherein the integrated circuit causes the deactivation of the lamp when the activation of the another one of the plurality of actuated switches is not sensed during the count process.

10. The electronic device as claimed in claim 8, wherein the device includes timekeeping circuitry for keeping and displaying time.

11. The electronic device as claimed in claim 10, wherein the device is a watch.

12. The electronic device as claimed in claim 8, wherein the first predetermined period of time is equal to the second predetermined period of time.

13. A method of illuminating a display in an electronic device comprising a display, a lamp for illuminating said display, a plurality of actuated switches one of which is a lamp switch that when activated, causes the activation of the lamp to illuminate the display, and an integrated circuit coupled to the plurality of actuated switches, the integrated circuit being able to sense the activation of each of the plurality of actuated switches, wherein the method comprises the steps of:

sensing the activation of the lamp switch;

activating the lamp to illuminate the display for a first predetermined period of time;

sensing the activation of another one of the plurality of actuated switches;

determining whether the another one of the plurality of actuated switches was activated while the display was illuminated; and if so maintaining the illumination of the display for a second predetermined period of time.

14. The method as claimed in claim 13, including the steps of:

starting a count process for a first predetermined period of time during which the illumination of the display is maintained;

determining whether the another one of the plurality of actuated switches was activated during the count process; and if so restarting the count process while maintaining the illumination of the display so that the illumination of the display is maintained for a second predetermined period of time beginning when the another one of the plurality of actuated switches was activated.

15. The method as claimed in claim 13, including the steps of:

starting a count process for a first predetermined period of time during which the illumination of the display is maintained;

determining whether the count process has terminated;

sensing whether the another one of the plurality of actuated switches was activated during the count process; and if so restarting the count process while maintaining the illumination of the display so that the illumination of the display is maintained for a second predetermined period of time beginning when the another one of the plurality of actuated switches was activated.

16. The method as claimed in claim 14, including the step of deactivating the lamp when the another one of the plurality of actuated switches is not activated during the count process.

17. The method as claimed in claim 13, wherein the count process includes the step of loading a counter with a predetermined value representative of the predetermined period of time, whereby the predetermined period of time is a period of time it takes for the counter to count to a preselected value.

18. The method as claimed in claim 17, wherein the count timer is a countdown counter and the method includes the step of having the countdown counter count down to zero.

19. The method as claimed in claim 13, wherein the electronic device includes timekeeping circuitry for keeping and displaying time.

20. The method as claimed in claim 19, wherein the electronic device is a watch.

* * * * *